United States Patent [19]

Wilson

[11] Patent Number: 4,575,175

[45] Date of Patent: Mar. 11, 1986

[54] EDGE CONNECTOR FOR MULTIPLE PRINTED CIRCUIT BOARDS

[75] Inventor: Bill B. Wilson, Clarendon Hills, Ill.

[73] Assignee: Molex Incorporated, Lisle, Ill.

[21] Appl. No.: 546,229

[22] Filed: Oct. 27, 1983

[51] Int. Cl.[4] ..... H01R 9/09

[52] U.S. Cl. ..... 339/176 MP; 339/217 S

[58] Field of Search ..... 339/176 MP, 217 S

[56] References Cited

U.S. PATENT DOCUMENTS

| | | | |
|---|---|---|---|
| 3,127,228 | 3/1964 | Greco et al. | 339/217 S |
| 3,778,753 | 12/1973 | Occhipinti et al. | 339/176 MP |
| 3,858,961 | 1/1975 | Goodman et al. | 339/176 MP |

FOREIGN PATENT DOCUMENTS

| | | | |
|---|---|---|---|
| 1810513 | 6/1970 | Fed. Rep. of Germany | 339/176 MP |

*Primary Examiner*—John McQuade

*Attorney, Agent, or Firm*—Louis A. Hecht

[57] ABSTRACT

An edge connector receptacle for electrically coupling pairs of printed circuit boards in parallel spaced apart relation includes a dielectric housing having a forward face formed with a pair of slots for receiving edges of the boards. The housing comprises integrally formed contact support means adapted with recesses for supporting a plurality of generally U-shaped contact members in communication between the slots. The recesses are open to a rear wall of the housing and have inner surfaces which taper to a relatively narrow cross-section toward the forward face of the housing. Shoulders formed at the bight portion of each contact cooperate with the tapered surfaces to limit movement of the contact in the direction of forward housing face. Pockets formed within the recesses cooperate with shoulder portions projecting from the end of each contact leg such that the ends of the contacts are captured and movement of the contact in the direction of the rear of the housing is prevented.

4 Claims, 4 Drawing Figures

EDGE CONNECTOR FOR MULTIPLE PRINTED CIRCUIT BOARDS

BACKGROUND OF THE INVENTION

1. Field of the Invention

The present invention relates generally to electrical connector assemblies for connecting printed circuit boards to other electrical apparatus, and in particular, to an improved contact arrangement for such connectors.

2. Brief Description of the Prior Art

A typical printed circuit board includes an insulative substrate on which a plurality of electronic circuitry devices have been mounted and electrically connected by means of conductive circuit paths defined on the boards. Where it is desired that the board serve as a module or subcomponent, it is particularly advantageous to utilize an edge connector as a socket or receptacle for receiving an edge of the board and forming electrical connections between the circuit paths and other circuitry apparatus. Edge connector receptacles may take various forms. However, they generally comprise a dielectric housing fitted with a plurality of discrete metallic contacts for slidingly engaging the conductive pads of the printed circuit board.

In certain applications, it might be desireable to interconnect two or more circuit boards in a jumper configuration whereby the boards are arranged in closely spaced parallel disposition with respect to one another. Such an arrangement has gained wide acceptance in the communications and data processing fields wherein compactness is a highly desired design consideration. An edge connector receptacle which provides for such parallel board interconnection is disclosed, for example, in Rilling, U.S. Pat. No. 4,322,120, issued Mar. 30, 1982.

In general, known edge connector receptacles of the foregoing type have a relatively complicated contact and contact mounting configuration which results in attendant manufacturing and assembly expense. This complexity is, for the most part, dictated by practical requirements. For example, the connector receptacle is preferably constructed such that the printed circuit boards are both rigidly supported and reliably interconnected. Moreover, for manufacturing efficiency, the connector contacts must be easily formed and mounted in a housing with reliable retention of the contacts in the housing over numerous mating and unmating cycles with a printed circuit board.

SUMMARY OF THE INVENTION

Accordingly, it is object of the present invention to provide an improved edge connector receptacle for interconnecting a printed circuit board to other electronic apparatus.

A further object is to provide an improved spring contact for such a receptacle which is easily formed and capable of developing suitably high contact forces when connected to the circuit board.

Still a further object is to provide a contact and housing arrangement in which the contact is easily inserted into the housing and reliably retained therein.

The foregoing and other objects and advantages are realized in the present invention wherein a connector assembly for receiving and electrically interconnecting a circuit board to another circuitry member is provided with contacts having a generally U-shape configuration with rearward stop means formed at the end of at least one leg of the U and with forward stop means formed at the bight of the U. The assembly further includes a dielectric housing adapted to receive the contacts in recesses having engaging means formed internally thereto for cooperation with the stop means and retention of each contact within its respective recess.

BRIEF DESCRIPTION OF THE DRAWINGS

The aforementioned objects and features of the invention, as well as other objects and features, will be better understood upon consideration of the following detailed description and appended claims taken in conjunction with the attached drawings of an illustrative embodiment thereof in which:

DESCRIPTION OF THE PREFERRED EMBODIMENT

Figure 1:
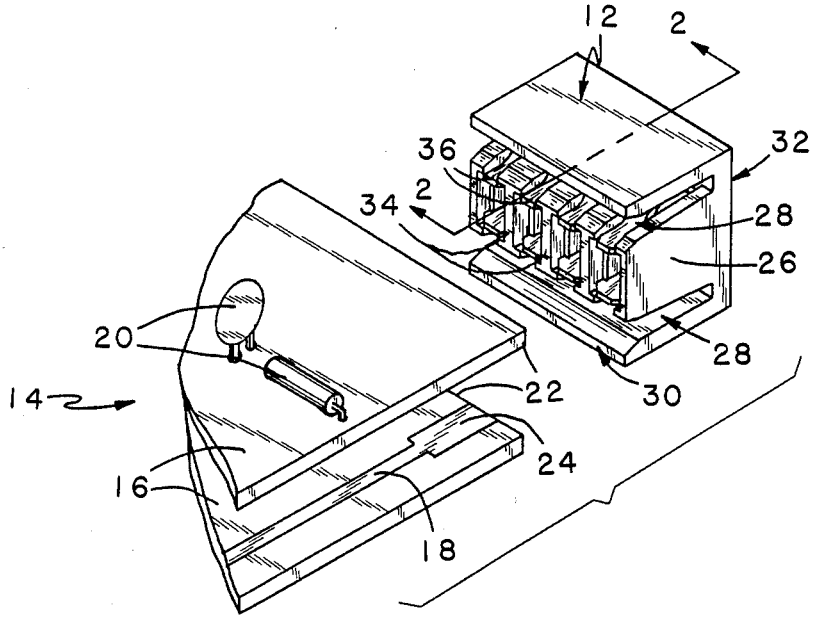
FIG. 1 is a perspective view of a connector assembly in accordance with the present invention.

Referring to the drawings, in FIG. 1, there is shown an edge connector receptacle 12 and a pair of printed circuit boards 14. Each printed circuit board 14 is constructed of a relatively rigid insulative substrate 16 on which a plurality of circuit paths 18 have been defined. In a manner well known in the art, the substrate 16 and circuit paths 18 cooperate to provide for the mounting and electrical connection of a plurality of electronic components such as resistors or capacitors 20. In order to, in turn, connect the electronic components 20 to other electronic apparatus external to the printed circuit boards 14, the circuit paths 18 are led to an edge 22 of the board 14 where they are terminated in slightly enlarged circuit pads 24.

The edge connector receptacle 12 includes a dielectric housing 26 formed with a pair of lengthwise slots 28 opening to a forward face 30 of the housing 26. Each slot 28 receives an edge 22 of one of the circuit boards 14.

Positioned intermediately of the slots 28 and extending from a rearward wall 32 of the housing 26 are contact support means, designated generally by the reference numeral 34. The contact support means 34 are formed integrally with the housing 26 and are adapted to receive and support a plurality of stamped and formed metallic contacts 36, in a manner which will be described in greater detail, hereinafter.

Figure 2:
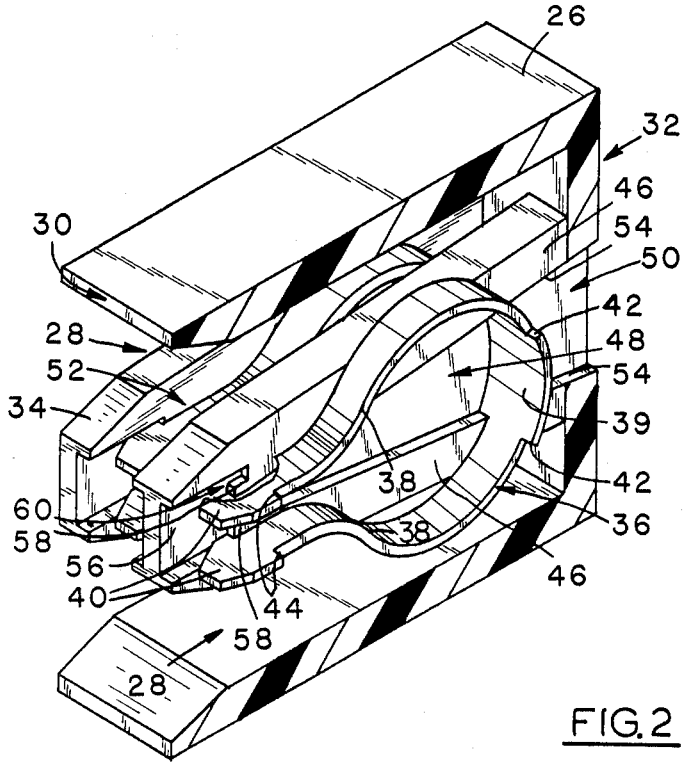
FIG. 2 is a cross-sectional view taken generally along the line 2—2 of FIG. 1 and illustrating a contact mounting arrangement in accordance with the present invention.

Turning now to the enlarged cross sectional view of FIG. 2, each contact 36 is seen to have a generally U-shape configuration defining a pair of legs 38 having free ends 40 extending in the general direction of the forward face 30 of the housing 26. The contact 36 is preferably constructed from a relatively thin unitary piece of spring metal such that its legs 38 are generally uniform in width. At its bight portion 39, the contact 36 is slightly enlarged in width defining pairs of oppositely directed shoulders 42. Likewise, the end 40 of each contact leg 38 is widened defining a pair of rearwardly facing shoulders 44.

In order to receive and support the contacts 36 within the edge connector housing 26, the contact support means 34 is seen in FIG. 2 to include a pair of opposed wall portions 46 defining a plurality of recesses 48 each with an opening 50 in the rearward wall 32 of the housing 26. The wall portions 46 are further adapted with generally elongated apertures 52 running between the rearward wall 32 and forward face 30 of the housing 26, permitting the legs 38 of the contacts 36 to extend from the recesses 48 into the slots 28 of the housing 26. The apertures 52 of both wall portions 46 are narrower than the recesses 48 but are slightly wider than the legs 38 of the contacts 36, thereby defining pairs of opposed wall surfaces 54 internal to the recesses 48. The pairs of internal surfaces 54 are generally divergent toward the rear wall 32 of the housing 26, such that the recesses 48 taper to a relatively larger cross section at the openings 50. Toward the forward face 30 of the housing 26 the surfaces 54 converge whereupon they are stepped abruptly outwardly defining an enlarged portion 56 of the recess 48. At the enlarged recess portion 56, the surfaces 54 terminate in lip projections 58 forming pairs of pockets 60 facing forwardly of the housing 26.

Figure 4:
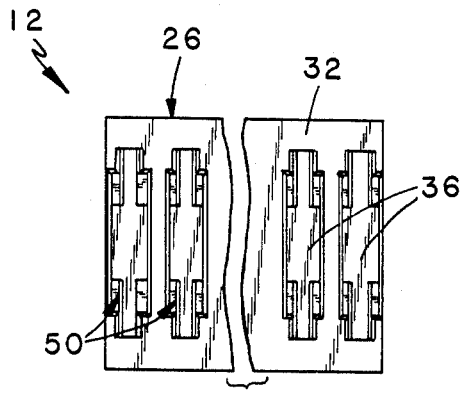
FIG. 4 is a rear elevational view of the assembly of FIG. 1.

With reference now to FIGS. 2 and 4, it can be appreciated that the contact members 36 are readily insertable into the receptacle 12 through the openings 50 provided in the rearward wall 32 of the housing 26. By suitable dimensioning of the apertures 52, as described hereinabove, the legs 38 of the contacts 36 are permitted to project into the slots 28 while the enlarged ends 40 and the bight 39 of the contact 36 are confined within the recess 48. Upon further insertion of the contact 36, the ends 40 reach the enlarged portion 56 of the recess 48 where they spring apart due to the natural resilience of the contact material. The depth of insertion of the contact 36 is limited by cooperation of the shoulders 42 of the bight portion 39 and the surfaces 54, due to the convergency of the surfaces 54 in the direction of contact insertion. By a slight reverse movement of the contact 36, either in the assembly process or by frictional interaction with a mating circuit board 14, the shoulders 44 of the contact end portions 40 seat within the pockets 60 and are captured therein.

Figure 3:
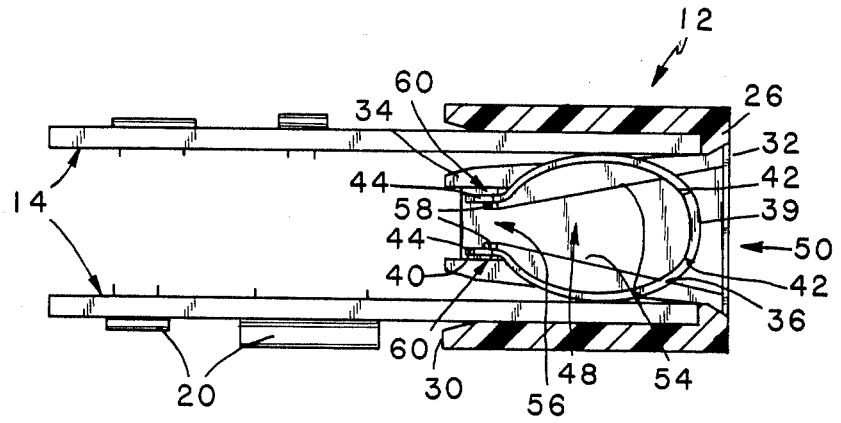
FIG. 3 is a side sectional view of the assembly of FIG. 1, illustrating the operation of the instant edge connector receptacle.

Turning now to FIG. 3, it can be seen that insertion of the printed circuit boards 14 into the edge connector receptacle 12 causes each contact 36 to collapse within its respective recess 48. However, movement of the contacts 36 in the direction of the rear wall 32 of the housing 26, and collapse of the contact ends 40, are prevented by engagement of the pockets 60 with the rearwardly facing shoulders 44 of the contact ends 40. Thus, the shoulders 44, in cooperation with the pockets 60, function as rearward stop means, preventing unintended withdrawal of the contacts 36 from the recesses 48 as the boards 14 are mated to the receptacle 12.

When one or both boards 14 are retracted from the receptacle 12 the shoulders 42 of the bight 39 oppose movement of the contacts 36 in the direction of the forward face 30 of the housing 26. Therefore, the shoulders 42, in cooperation with the recess surfaces 54, function as forward stop means, preventing excessive movement of the contacts 36 during unmating of the boards 14 from the receptacle 12.

It can be appreciated that by proper selection of the contact material, suitably high forces can be achieved at the interface between the contacts 36 and the circuit pads 24 of the board assemblies 14. These forces are further enhanced by the widening of the contact 36 at the bight 39 where the moment of bending of each leg 38 is the greatest. Accordingly, widening of the contact 36 at its bight portion 39 serves a dual function of both contact retention and strengthening.

The contact 36 is not limited in its application to the coupling of pairs of circuit boards. Any number of circuitry devices may be interconnected with the use of the instant contact 39 with appropriate variation of the housing structure. The unitary nature of the contact, and its relative simplicity of structure, make it readily manufacturable by known stamping and forming techniques.

I claim:

1. A connector assembly for receiving and electrically interconnecting two parallel spaced-apart circuit boards each having a plurality of circuit pads defined along an edge thereof, the assembly including a dielectric housing with at least one slot opened to a forward face of the housing for receiving the edges of the circuit boards, and support means formed integrally with the housing and adapted with wall portions having recesses receiving and supporting a plurality of metallic contacts in engagement with the circuit pads of the circuit boards, each contact formed from a unitary piece of stamped resilient sheet metal of generally U-shaped configuration including a rearward bight portion joining two spaced-apart forwardly extending leg portions, each leg portion having a contact portion formed thereon adapted to engage a circuit pad on each of the two circuit boards, each contact further including rearward stop means formed on at least one leg portion cooperating with a portion of the recess to prevent movement of the contact in a rearward direction and forward stop means formed on the bight portion to prevent movement of the contact in the forward direction and in a direction toward the other circuit board, the improvement comprising:

each contact having a smoothly and continuously curved configuration;

each of said housing recesses including a pair of opposing forwardly converging wall portions for cooperation with said forward stop means and forwardly located shoulders for cooperation with said rearward stop means; and said U-shaped contact being resiliently compressed when said circuit boards are mounted in the connector assembly, so that said forward stop means is moved out of engagement with said wall portions with portions of said contact adjacent said bight being free to move between said circuit boards, whereby contact forces imparted to one leg contact portion are capable of being at least partially transmitted to the other leg contact portion.

2. The connector assembly of claim 1 wherein the forward stop means of each contact includes a relatively enlarged portion of the bight of the contact.

3. The connector assembly of claim 1 wherein the rearward stop means of each contact includes a relatively enlarged portion of a leg portion of the contact.

4. The connector assembly of claim 1 wherein the rearward stop means includes a relatively enlarged portion of each leg portion of the contact, and the housing further includes a contact engaging means having a pocket formed in a wall portion of each recess, the pocket and enlarged portion of the leg portion cooperating to capture the end of the contact leg portion and limit movement of the contact in the general direction of a rearward face of the housing.

* * * * *